US008403509B2

(12) United States Patent
Chin et al.

(10) Patent No.: US 8,403,509 B2
(45) Date of Patent: Mar. 26, 2013

(54) LED LAMP WHOSE LIGHTING DIRECTION CAN BE ADJUSTED EASILY AND QUICKLY

(76) Inventors: Hua-Chun Chin, Taipei Hsien (TW); Hung-Yuan Lin, Taipei (TW); Fu-Wi Teng, Zhongli (TW)

( * ) Notice: Subject to any disclaimer, the term of this patent is extended or adjusted under 35 U.S.C. 154(b) by 296 days.

(21) Appl. No.: 12/897,839

(22) Filed: Oct. 5, 2010

(65) Prior Publication Data

US 2012/0080994 A1 Apr. 5, 2012

(51) Int. Cl.
*F21V 21/14* (2006.01)
*F21S 10/06* (2006.01)

(52) U.S. Cl. ..... 362/35; 362/249.02; 362/249.03; 362/269

(58) Field of Classification Search ..... 362/35, 362/249.1, 249.02, 249.07, 249.03, 429, 362/269; 313/318.03
See application file for complete search history.

(56) References Cited

U.S. PATENT DOCUMENTS

| | | | | |
|---|---|---|---|---|
| 5,575,459 | A * | 11/1996 | Anderson | 362/240 |
| 6,843,656 | B2 * | 1/2005 | Hwang et al. | 439/11 |
| 8,118,447 | B2 * | 2/2012 | Simon et al. | 362/235 |
| 8,172,436 | B2 * | 5/2012 | Coleman et al. | 362/421 |
| 2011/0110118 | A1 * | 5/2011 | Hsiao | 362/643 |
| 2012/0019137 | A1 * | 1/2012 | Safarikas et al. | 315/35 |

* cited by examiner

*Primary Examiner* — Peggy A. Neils
(74) *Attorney, Agent, or Firm* — Alan Kamrath; Kamrath IP Lawfirm, P.A.

(57) ABSTRACT

An LED lamp includes a housing, a conducting ring mounted on the housing, a shade swivelably mounted on the housing, an LED module mounted on the shade, and two conducting pins each electrically connected with the LED module and each electrically connected with the conducting ring. Thus, when the LED module is moved in concert with the shade, each of the two conducting pins is slidably in contact with the conducting ring to connect the LED module electrically with the conducting ring and to connect the LED module electrically with the metallic base and the power contact plate through the conducting ring so as to form an electrical circuit so that the LED module can be rotated through three hundred and sixty degrees (360°) so as to change the lighting direction of the LED module.

17 Claims, 4 Drawing Sheets

LED LAMP WHOSE LIGHTING DIRECTION CAN BE ADJUSTED EASILY AND QUICKLY

BACKGROUND OF THE INVENTION

1. Field of the Invention

The present invention relates to a lamp and, more particularly, to an LED (light emitting diode) lamp to provide an illuminating function.

2. Description of the Related Art

A conventional LED (light emitting diode) lamp comprises a power connector, a shade combined with the power connector, and an LED module mounted in the shade to emit light outwardly so as to provide a lighting function. However, the shade is fixed to the power connector so that the shade cannot be rotated relative to the power connector to change the lighting direction of the LED module.

BRIEF SUMMARY OF THE INVENTION

In accordance with the present invention, there is provided an LED lamp, comprising a housing, a conducting ring mounted on the housing, a shade swivelably mounted on the housing, an LED module mounted on the shade to move in concert with the shade, and two conducting pins each electrically connected with the LED module and each electrically connected with the conducting ring.

The housing has an inner portion provided with a mounting socket. The shade has a bottom plate which is provided with a rotation shaft rotatably mounted in the mounting socket of the housing. Each of the two conducting pins has an upper end electrically connected with the LED module and a lower end slidably in contact with the conducting ring. Each of the two conducting pins is mounted on the bottom plate of the shade to move in concert with the shade so that each of the two conducting pins is movable relative to the housing and the conducting ring. Preferably, the upper end of each of the two conducting pins is secured to a lower end of the LED module. The shade has a side provided with an opening for mounting the LED module and the heatsink module. The shade is rotatable relative to the housing through three hundred and sixty degrees (360°). The LED lamp further comprises a heatsink module mounted on the shade and abutting the LED module. The LED module 1 includes a light source facing the shade and a heat conducting layer located between the light source and the heatsink module. The heatsink module has a first side abutting the heat conducting layer of the LED module and a second side provided with a plurality of elongate radiating fins which are spaced from and parallel with each other to enhance the heatsink area of the heatsink module. The LED lamp further comprises a mounting seat mounted on the housing, a metallic base mounted on the mounting seat and electrically connected with the conducting ring, a power contact plate mounted on the mounting seat and electrically connected with the conducting ring, and an insulating jacket mounted on the mounting seat.

The primary objective of the present invention is to provide an LED lamp whose lighting direction can be adjusted easily and quickly.

According to the primary advantage of the present invention, when the LED module is moved in concert with the shade, each of the two conducting pins is slidably in contact with the conducting ring to connect the LED module electrically with the conducting ring and to connect the LED module electrically with the metallic base and the power contact plate through the conducting ring so as to form an electrical circuit so that the LED module can be rotated through three hundred and sixty degrees (360°) so as to change the lighting direction of the LED module.

According to another advantage of the present invention, the shade and the LED module are swiveled relative to the housing freely without having to move the housing during movement of the shade and the LED module to facilitate a user adjusting the lighting direction of the LED module and to prevent the electric cord from being twisted or tangled.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
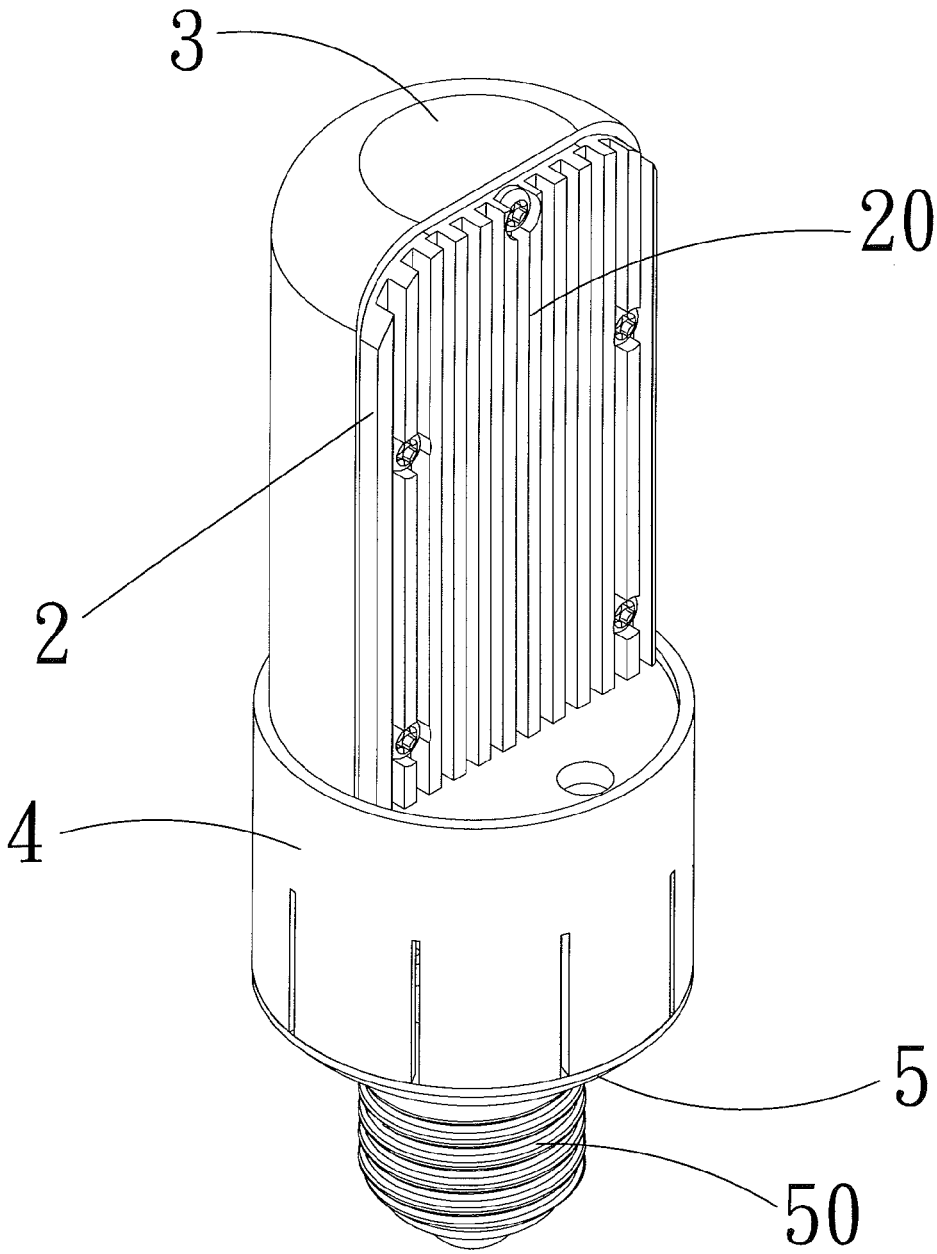
FIG. 1 is a perspective view of an LED lamp in accordance with the preferred embodiment of the present invention.
Figure 2:
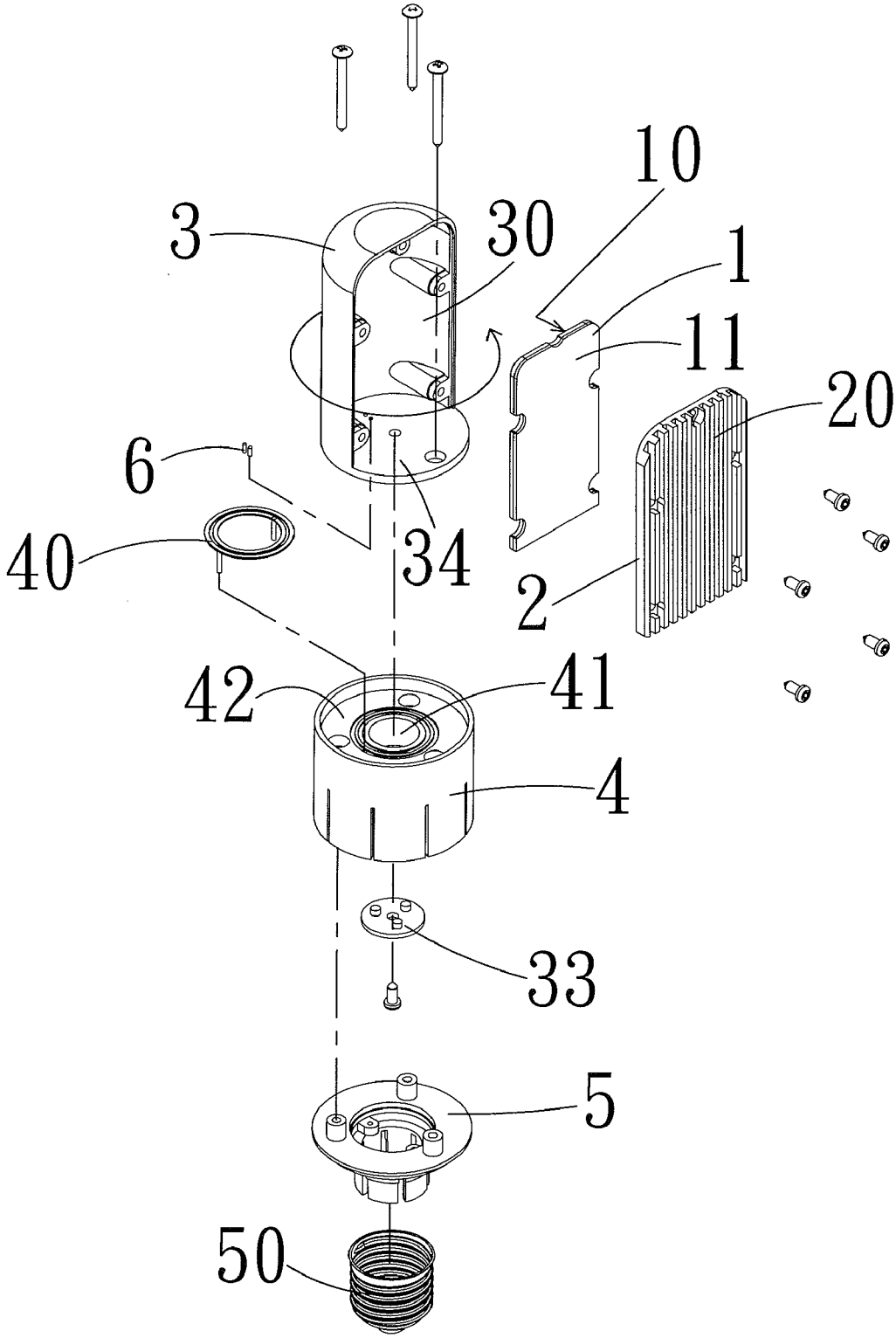
FIG. 2 is an exploded perspective view of the LED lamp as shown in FIG. 1.
Figure 3:
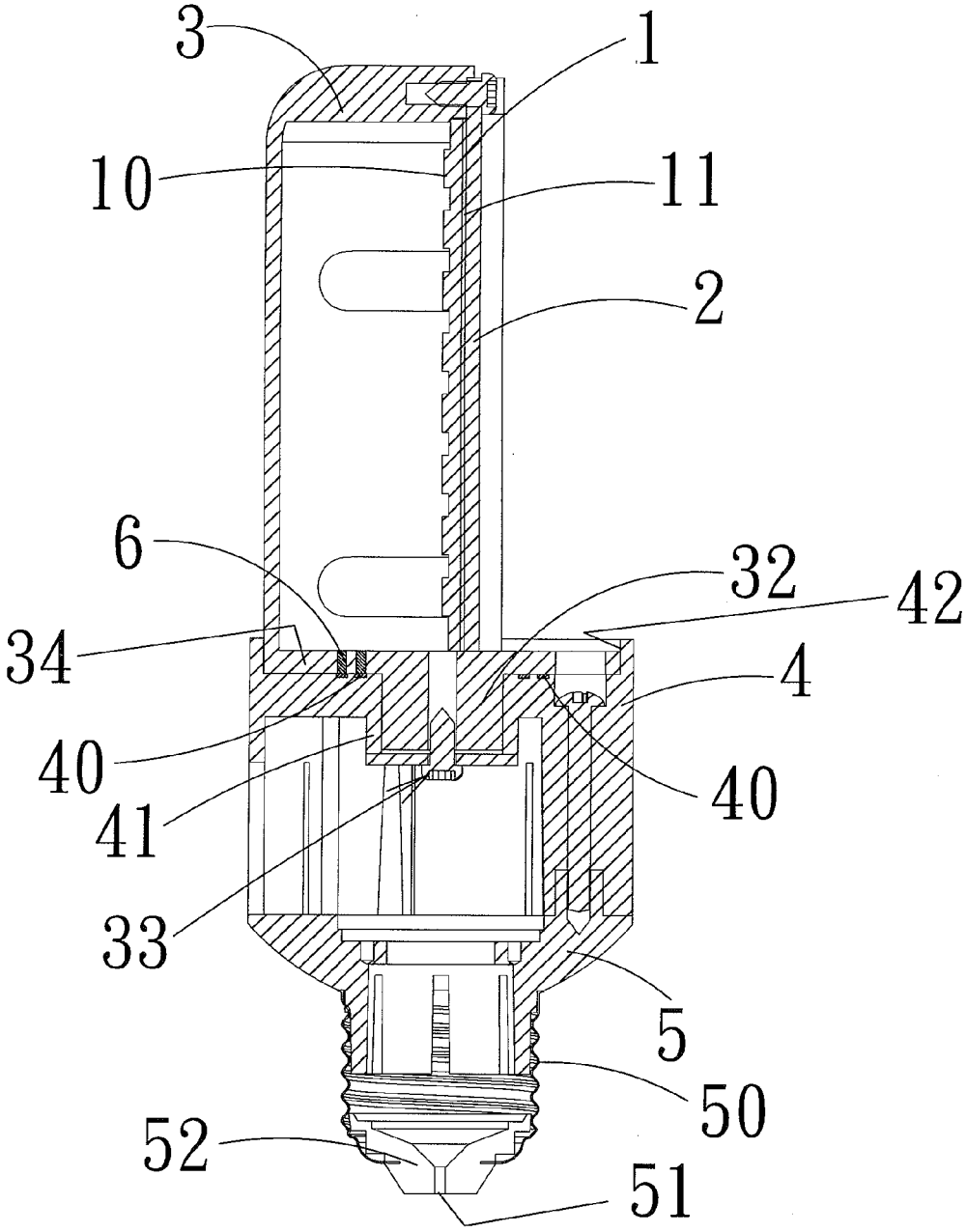
FIG. 3 is a front cross-sectional view of the LED lamp as shown in FIG. 1.

Referring to the drawings and initially to FIGS. 1-3, an LED (light emitting diode) lamp in accordance with the preferred embodiment of the present invention comprises a housing 4, a conducting ring 40 mounted on the housing 4, a shade 3 swivelably mounted on the housing 4, an LED module 1 mounted on the shade 3 to move in concert with the shade 3, a heatsink module 2 mounted on the shade 3 and abutting the LED module 1, two conducting pins 6 each electrically connected with the LED module 1 and each electrically connected with the conducting ring 40, a mounting seat 5 mounted on the housing 4, a metallic base 50 mounted on the mounting seat 5 and electrically connected with the conducting ring 40, a power contact plate 51 mounted on the mounting seat 5 and electrically connected with the conducting ring 40, and an insulating jacket 52 mounted on the mounting seat 5.

The housing 4 has an inner portion provided with a mounting socket 41. The mounting socket 41 of the housing 4 is located at a central portion of the housing 4 and has a substantially tubular shape. The housing 4 has an upper end provided with a mounting recess 42 located above the mounting socket 41.

The conducting ring 40 is made of metal. The conducting ring 40 is located in the mounting socket 41 of the housing 4 and is co-axial with the mounting socket 41 of the housing 4.

The mounting seat 5 has an upper end secured on a lower end of the housing 4 and a lower end provided with the metallic base 50, the power contact plate 51 and the insulating jacket 52.

The LED module 1 includes a light source 10 facing the shade 3 and a heat conducting layer 11 located between the light source 10 and the heatsink module 2. In the preferred embodiment of the present invention, the light source 10 of the LED module 1 is a light emitting diode. In practice, when the LED module 1 is an alternating current LED module, the metallic base 50 and the power contact plate 51 are directly connected with the conducting ring 40. Alternatively, when the LED module 1 is a direct current LED module, the metallic base 50 and the power contact plate 51 are indirectly connected with the conducting ring 40 through a rectifier (not shown).

The heatsink module 2 has a first side abutting the heat conducting layer 11 of the LED module 1 and a second side provided with a plurality of elongate radiating fins 20 which are spaced from and parallel with each other to enhance the heatsink area of the heatsink module 2. The heatsink module 2 forms a porous structure with a great heat dissipation feature and a high specific surface area. The porous structure formed by the heatsink housing 2 is made of a nonmetallic powder (formed by an injection molding process) having a great heat conductivity, such as $Al_2O_3$, $Zr_2O$, AlN, SiN, BN, WC, C, SiC, crystalline SiC, Recrystalline SiC (ReSiC) and the like.

The shade 3 has a side provided with an opening 30 for mounting the LED module 1 and the heatsink module 2. The shade 3 has a bottom plate 34 which is provided with a rotation shaft 32 rotatably mounted in the mounting socket 41 of the housing 4 so that the shade 3 is rotatable relative to the housing 4 through three hundred and sixty degrees (360°). The bottom plate 34 of the shade 3 is rotatably mounted in the mounting recess 42 of the housing 4. The rotation shaft 32 of the shade 3 protrudes outwardly from the bottom plate 34 of the shade 3 and is located at a central portion of the bottom plate 34 of the shade 3. The rotation shaft 32 of the shade 3 is attached to the mounting socket 41 of the housing 4 by a fastening unit 33.

Each of the two conducting pins 6 is made of metal. In the preferred embodiment of the present invention, each of the two conducting pins 6 is mounted on the bottom plate 34 of the shade 3 to move in concert with the shade 3 so that each of the two conducting pins 6 is movable relative to the housing 4 and the conducting ring 40. Each of the two conducting pins 6 has an upper end electrically connected with the LED module 1 and a lower end slidably in contact with the conducting ring 40.

In operation, when the shade 3 is swiveled relative to the housing 4, the LED module 1 is moved in concert with the shade 3 and can be rotated through three hundred and sixty degrees (360°) so as to change the lighting direction of the LED module 1. At this time, when each of the two conducting pins 6 is moved in concert with the shade 3, each of the two conducting pins 6 is electrically connected with the LED module 1 and is slidably in contact with the conducting ring 40 so that each of the two conducting pins 6 is electrically connected between the LED module 1 and the conducting ring 40 to connect the LED module 1 electrically with the metallic base 50 and the power contact plate 51 so as to connect the LED module 1 electrically with an external power supply (not shown).

Figure 4:
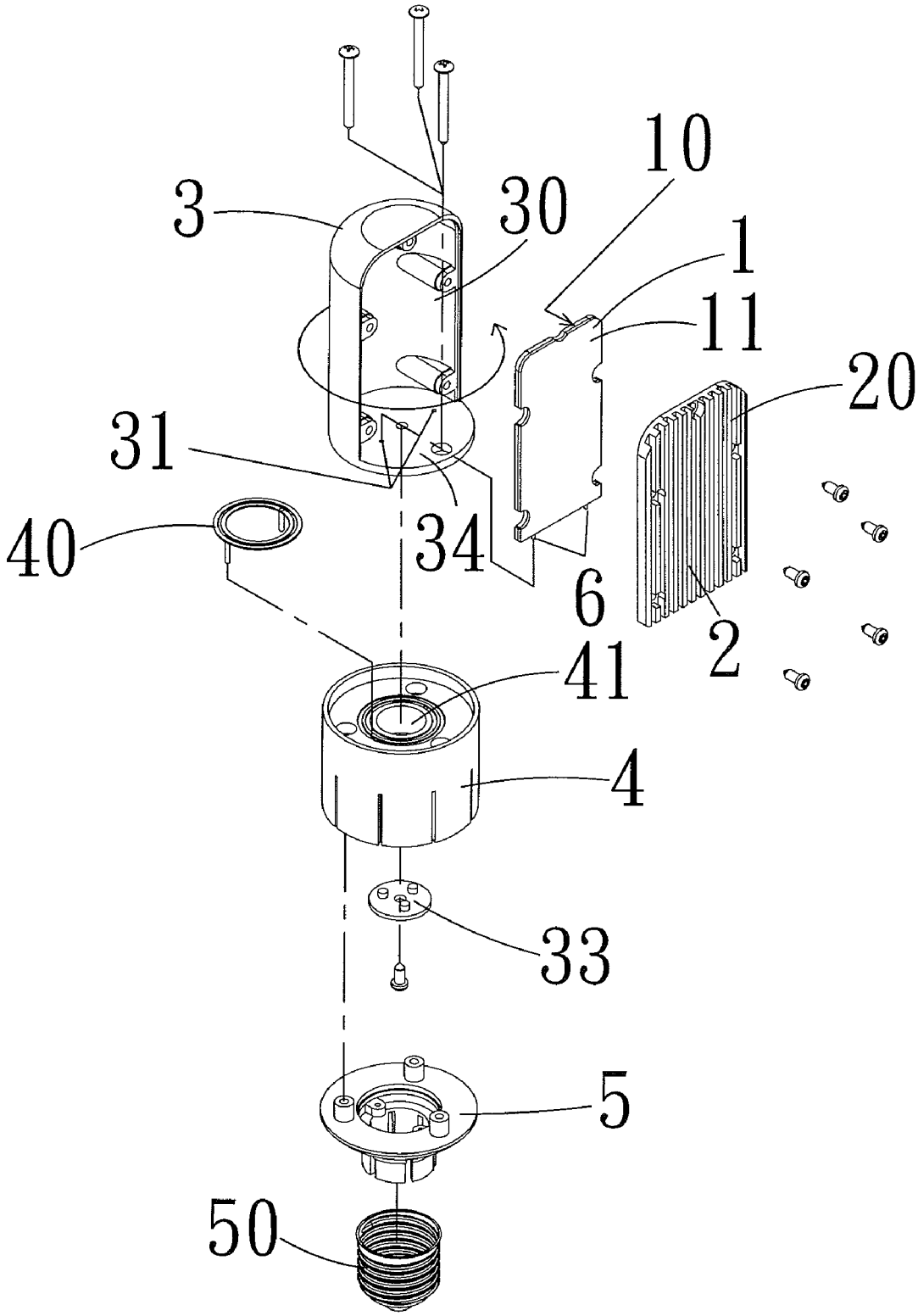
FIG. 4 is an exploded perspective view of an LED lamp in accordance with another preferred embodiment of the present invention.

Referring to FIG. 4, the upper end of each of the two conducting pins 6 is secured to a lower end of the LED module 1, and the bottom plate 34 of the shade 3 has a surface provided with two through holes 31 to allow passage of the two conducting pins 6.

Accordingly, when the LED module 1 is moved in concert with the shade 3, each of the two conducting pins 6 is slidably in contact with the conducting ring 40 to connect the LED module 1 electrically with the conducting ring 40 and to connect the LED module 1 electrically with the metallic base 50 and the power contact plate 51 through the conducting ring 40 so as to form an electrical circuit so that the LED module 1 can be rotated through three hundred and sixty degrees (360°) so as to change the lighting direction of the LED module 1. In addition, the shade 3 and the LED module 1 are swiveled relative to the housing 4 freely without having to move the housing 4 during movement of the shade 3 and the LED module 1 to facilitate a user adjusting the lighting direction of the LED module 1 and to prevent the electric cord from being twisted or tangled.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An LED lamp comprising:

a housing;

a conducting ring mounted on the housing;

a shade swivelably mounted on the housing; an LED module mounted on the shade to move in concert with the shade; and two conducting pins each electrically connected with the LED module and each electrically connected with the conducting ring, wherein:

the housing has an inner portion provided with a mounting socket; and the shade has a bottom plate provided with a rotation shaft rotatably mounted in the mounting socket of the housing.

2. The LED lamp of claim 1, wherein the rotation shaft of the shade is attached to the mounting socket of the housing by a fastening unit.

3. The LED lamp of claim 1, wherein each of the two conducting pins has an upper end electrically connected with the LED module and a lower end slidably in contact with the conducting ring.

4. The LED lamp of claim 3, wherein:

each of the two conducting pins is mounted on the bottom plate of the shade to move in concert with the shade; and each of the two conducting pins is movable relative to the housing and the conducting ring.

5. The LED lamp of claim 4, wherein the upper end of each of the two conducting pins is secured to a lower end of the LED module.

6. The LED lamp of claim 4, wherein the bottom plate of the shade has a surface provided with two through holes to allow passage of the two conducting pins.

7. The LED lamp of claim 1, wherein the shade is rotatable relative to the housing through three hundred and sixty degrees (360°).

8. The LED lamp of claim 1, wherein:

the mounting socket of the housing is located at a central portion of the housing; and the rotation shaft of the shade protrudes outwardly from the bottom plate of the shade and is located at a central portion of the bottom plate of the shade.

9. The LED lamp of claim 1, wherein the mounting socket of the housing has a substantially tubular shape.

10. The LED lamp of claim 1, wherein the conducting ring is located in the mounting socket of the housing.

11. The LED lamp of claim 1, wherein the conducting ring is co-axial with the mounting socket of the housing.

12. The LED lamp of claim 2, wherein:

the housing has an upper end provided with a mounting recess located above the mounting socket; and the bottom plate of the shade is rotatably mounted in the mounting recess of the housing.

13. The LED lamp of claim 1, wherein the LED lamp further comprises:

a heatsink module mounted on the shade and abutting the LED module.

14. The LED lamp of claim 13, wherein the shade has a side provided with an opening for mounting the LED module and the heatsink module.

15. The LED lamp of claim 13, wherein:

the LED module includes:

a light source facing the shade; and a heat conducting layer located between the light source and the heatsink module; and the heatsink module has a first side abutting the heat conducting layer of the LED module and a second side provided with a plurality of elongate radiating fins spaced from and parallel with each other to enhance a heatsink area of the heatsink module.

16. The LED lamp of claim 1, wherein:

the conducting ring is made of metal; and each of the two conducting pins is made of metal.

17. The LED lamp of claim 1, wherein the LED lamp further comprises:

a mounting seat mounted on the housing;

a metallic base mounted on the mounting seat and electrically connected with the conducting ring;

a power contact plate mounted on the mounting seat and electrically connected with the conducting ring; and an insulating jacket mounted on the mounting seat.

* * * * *